US010687618B2

(12) United States Patent
Diemel, Jr. et al.

(10) Patent No.: US 10,687,618 B2
(45) Date of Patent: Jun. 23, 2020

(54) MEDICINE CABINET

(71) Applicant: Kohler Co., Kohler, WI (US)

(72) Inventors: Douglas J. Diemel, Jr., Kohler, WI (US); David P. Ourada, Sheboygan, WI (US)

(73) Assignee: Kohler Co., Kohler, WI (US)

( * ) Notice: Subject to any disclaimer, the term of this patent is extended or adjusted under 35 U.S.C. 154(b) by 0 days.

(21) Appl. No.: 16/214,698

(22) Filed: Dec. 10, 2018

(65) Prior Publication Data

US 2019/0174917 A1 Jun. 13, 2019

Related U.S. Application Data

(60) Provisional application No. 62/597,838, filed on Dec. 12, 2017.

(51) Int. Cl.

| | |
|---|---|
| ***A47B 67/02*** | (2006.01) |
| ***E05D 15/02*** | (2006.01) |
| ***A47B 55/00*** | (2006.01) |
| ***A47B 67/00*** | (2006.01) |

(52) U.S. Cl.

CPC ..... *A47B 67/02* (2013.01); *A47B 55/00* (2013.01); *A47B 67/005* (2013.01); *E05D 15/02* (2013.01); *A47B 2220/0072* (2013.01)

(58) Field of Classification Search

CPC ..... A47B 67/02; A47B 67/005; A47B 55/00; A47B 2220/0072; E05D 15/02

See application file for complete search history.

(56) References Cited

U.S. PATENT DOCUMENTS

| | | | | |
|---|---|---|---|---|
| 2,439,664 | A * | 4/1948 | Marchand | A47B 67/02 312/242 |
| 2,642,331 | A | 6/1953 | Sprinkle | |
| 2,690,950 | A * | 10/1954 | Nordmark | A47B 41/02 312/310 |
| 4,134,625 | A | 1/1979 | Palka | |
| 4,189,195 | A * | 2/1980 | Turney | A47B 67/005 312/209 |
| 4,195,416 | A | 4/1980 | Hall | |
| 5,267,786 | A * | 12/1993 | Aisley | A47B 67/02 248/468 |
| 5,484,196 | A | 1/1996 | Kim | |
| 5,577,819 | A | 11/1996 | Olsen | |
| 9,644,834 | B2 | 5/2017 | Cano et al. | |
| 9,675,172 | B2 | 6/2017 | Pandorf et al. | |
| 9,857,071 | B2 | 1/2018 | Cano et al. | |

(Continued)

FOREIGN PATENT DOCUMENTS

| | | |
|---|---|---|
| CN | 206135234 U | 4/2017 |
| CN | 207490319 U | 6/2018 |

(Continued)

*Primary Examiner* — Hanh V Tran
(74) *Attorney, Agent, or Firm* — Foley & Lardner LLP

(57) ABSTRACT

A medicine cabinet includes a side panel, a door, and a hinge. The side panel includes a notch on an edge of the side panel. The door includes a projection extending outwardly from an inner surface of the door. The hinge pivotally couples the door to the side panel. The hinge includes a first portion coupled to the projection and a second portion coupled to the side panel. The projection and the first portion are received in the notch when the door is in a closed position.

20 Claims, 6 Drawing Sheets

(56) References Cited

U.S. PATENT DOCUMENTS

| | | | | |
|---|---|---|---|---|
| 2003/0042828 | A1 | 3/2003 | Bonin | |
| 2006/0119235 | A1 | 6/2006 | Aisley et al. | |
| 2007/0120451 | A1 | 5/2007 | Lamar | |
| 2007/0241259 | A1 | 10/2007 | Pandorf et al. | |
| 2011/0283632 | A1* | 11/2011 | Sutton | A47B 46/005 52/36.1 |
| 2015/0320209 | A1* | 11/2015 | Hasselback | H04N 5/2251 348/151 |
| 2017/0099945 | A1 | 4/2017 | Meads | |
| 2018/0235366 | A1* | 8/2018 | Pyle | A47B 95/008 |
| 2018/0245383 | A1* | 8/2018 | Jeffries | E05C 3/008 |
| 2018/0249827 | A1* | 9/2018 | Kim | A47B 47/0091 |
| 2019/0055764 | A1* | 2/2019 | Zhu | E05D 11/0081 |

FOREIGN PATENT DOCUMENTS

| | | | |
|---|---|---|---|
| JP | 2001292535 | A | 10/2001 |
| JP | 2008136736 | A | 6/2008 |

* cited by examiner

MEDICINE CABINET

CROSS-REFERENCE TO RELATED APPLICATIONS

This application claims the benefit of and priority to U.S. Provisional Application No. 62/597,838, filed Dec. 12, 2017, the entire disclosure of which is hereby incorporated by reference herein.

BACKGROUND

The present application relates generally to cabinets for use in bathrooms and the like (e.g., medicine cabinets), although the concepts disclosed herein may also be employed in cabinets used in other locations and for other purposes. For ease of description, the following description will refer generally to such cabinets as "medicine cabinets."

Medicine cabinets are a useful fixture in residential homes, as they allow a user to store toiletries to reduce clutter around, for example, a sink area. Medicine cabinets frequently include a mirror on the front surface of the cabinet, so as to maximize utility of the fixture. Most medicine cabinets are configured with internal shelves that extend the entire width of the cabinet. While this configuration can be useful for storing objects like toothpaste, toothbrushes and combs, consumers often must still resort to a countertop or under a sink for storing taller or larger objects such as hairspray bottles or electric toothbrushes.

In addition, to optimize the aesthetic appearance of mirrored medicine cabinets, most medicine cabinets are designed such that the mirrored door extends lower than, or at least to the same level as, the bottom of the medicine cabinet box. In cases where the medicine cabinet is placed on the floor or another surface prior to installation, this may result in damage to the mirror, because the mirror is generally the first component to contact the floor.

Medicine cabinet doors are typically connected to the frame or box of the medicine cabinet using hinges having any of a variety of configurations. One challenge associated with traditional cabinets is that creating a thinner medicine cabinet often means that conventional hinge designs can no longer be employed, since there is no space for the hinge to be accommodated.

It would be advantageous to provide an improved medicine cabinet that addresses these and other issues.

SUMMARY

At least one embodiment of the present application relates to a medicine cabinet including a side panel, a door, and a hinge. The side panel includes a notch on an edge of the side panel. The door includes a projection extending outwardly from an inner surface of the door. The hinge pivotally couples the door to the side panel. The hinge includes a first portion coupled to the projection and a second portion coupled to the side panel. The projection and the first portion are received in the notch when the door is in a closed position.

Another embodiment relates to a medicine cabinet including a side panel, a door, and a hinge. The side panel includes a cutout on a side edge of the side panel. The door includes a localized projection extending outwardly from an inner surface of the door. The hinge pivotally couples the door to the side panel. The hinge includes a first portion coupled to the localized projection and a second portion coupled to the side panel. The localized projection and the first portion are received in the cutout when the door is in a closed position.

Yet another embodiment relates to a medicine cabinet including a side panel, a door, and a hinge. The side panel includes a recessed portion along an edge of the side panel. The door includes a projection extending outwardly from an inner surface of the door. The hinge pivotally couples the door to the side panel. The hinge includes a first portion coupled to the projection and a second portion coupled to the side panel adjacent the recessed portion. The projection is received in the recessed portion when the door is in a closed position.

Those skilled in the art will appreciate that the summary is illustrative only and is not intended to be in any way limiting. Other aspects, inventive features, and advantages described herein, will become apparent in the detailed description set forth herein and taken in conjunction with the accompanying drawings.

DETAILED DESCRIPTION

Figure 1:
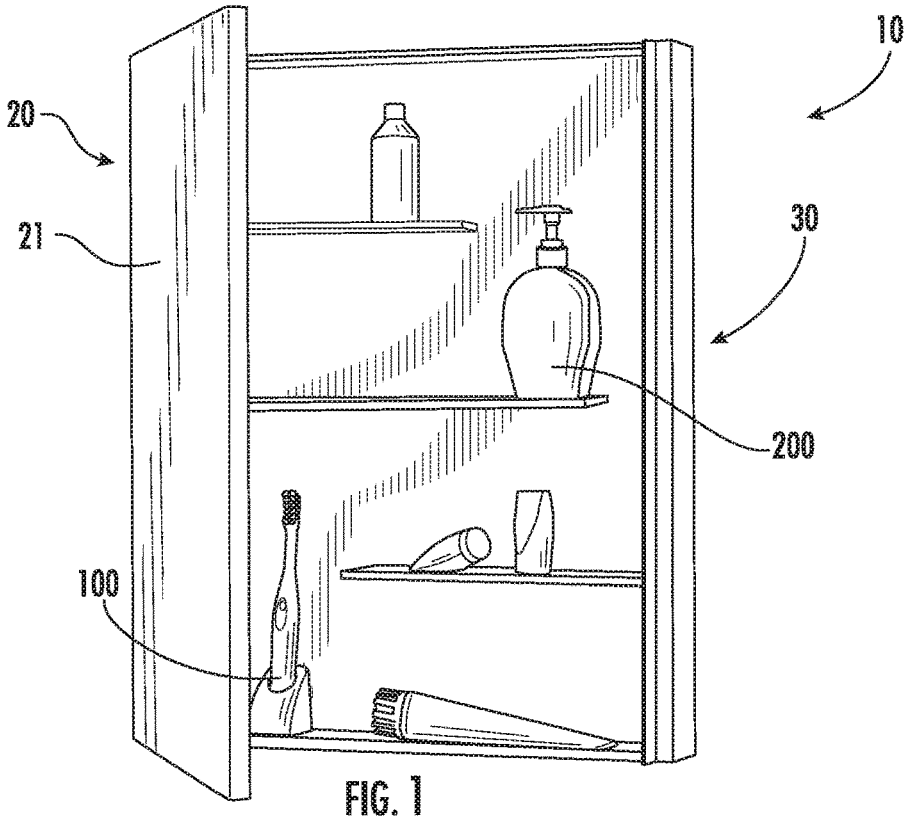
FIG. 1 is a perspective view of a medicine cabinet according to an exemplary embodiment.

The present application overcomes the drawbacks of traditional medicine cabinets by providing a compact solution that allows for taller objects to be stored within the medicine cabinet. The disclosed medicine cabinet also includes features that allow for customization of the medicine cabinet and can provide for improvements relating to shipping and installation of the cabinet. In addition, the disclosed medicine cabinet includes a compact hinge design that can reduce the overall size of the cabinet.

At least one embodiment of the present application relates to a medicine cabinet having a cabinet box with a cabinet door, a top panel, and two side panels joining the top and bottom panel. The medicine cabinet may include at least one shelf that extends an entire width of the cabinet box. The cabinet may also include a plurality of cantilevered shelves that extend only a partial width of the cabinet box. The shelves may include retaining lips at the external edges of the shelves (e.g., at the front edge of both types of shelves, and on the lateral ends of the partial-width shelves). The at least one shelf extending the entire width of the cabinet box may be disposed vertically between a first cantilevered shelf extending from one side panel, and a second cantilevered shelf extending from the other side panel. In addition, the top panel and bottom panel are interchangeable to permit the cabinet to be inverted for installation in an opposite hand configuration.

In some exemplary embodiments, the cantilevered shelves are configured such that the first cantilevered shelf extends from a left side panel and the second cantilevered shelf extends from a right side panel. The cantilevered shelves may be hollow extrusions, and may receive a fastener within the hollow extrusions for mounting. The cantilevered shelves may receive a fastener from a back surface of the cantilevered shelves.

In some exemplary embodiments, the medicine cabinet may further include a plurality of aesthetic side panels which are disposed along an outer surface of the side panels of the cabinet box. The side panels may be reversible, and may have a first color on a first side and a second color on a second side.

In some exemplary embodiments, the medicine cabinet may further include a plurality of generally L-shaped end caps which are disposed on a bottom portion of the side panels and extend horizontally inward against the bottom panel. The plurality of generally L-shaped end caps may be press-fit into the plurality of rails, and may be configured to support the aesthetic side panels. A bottom surface of the end caps may be vertically lower than a bottom surface of the cabinet door. The front surface of the cabinet door may be a mirror.

In some exemplary embodiments, the medicine cabinet may include at least one hinge mechanism which pivotally couples the cabinet door and the cabinet box, wherein the hinge mechanism is disposed along a left side of the box and includes a hinge bar along an inner surface of the cabinet door which receives a first hinge portion, and a second hinge portion coupled to an edge of a side panel of the cabinet box. The hinge bar may include a projection to receive the first hinge portion, and the edge of the side panel may include a notch to receive at least a portion of the hinge bar therein when the cabinet door is in a closed position.

Figure 2:
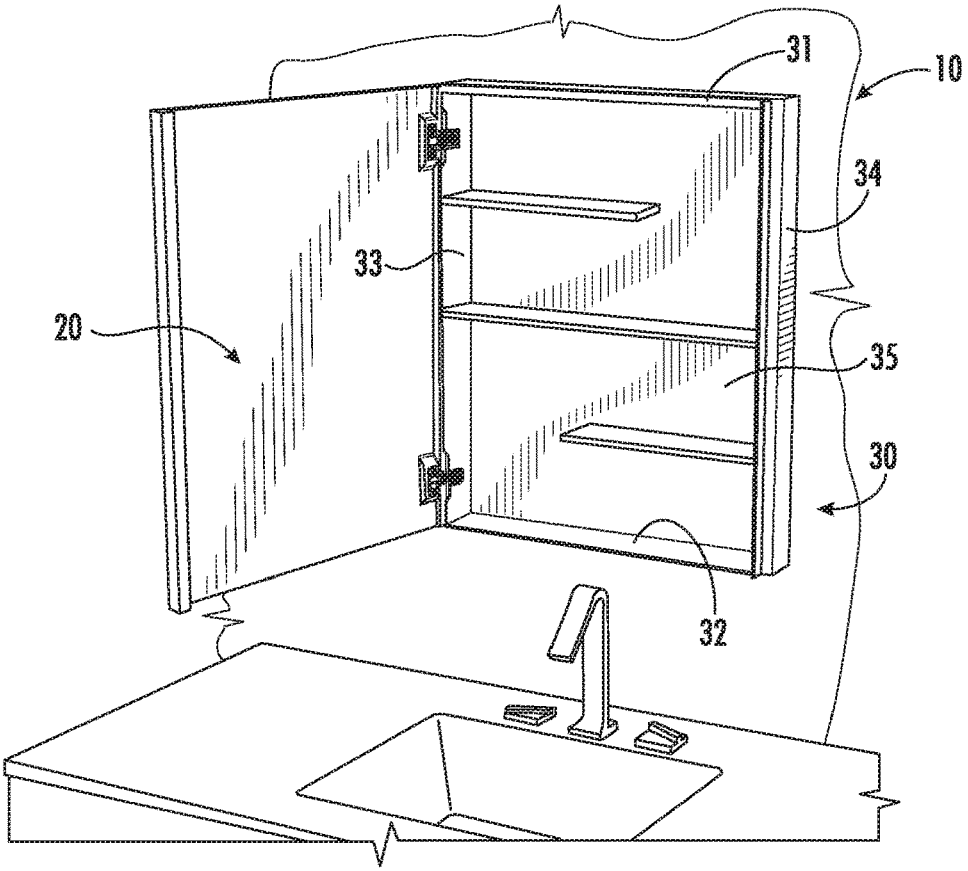
FIG. 2 is another perspective view of the medicine cabinet of FIG. 1.
Figure 3:
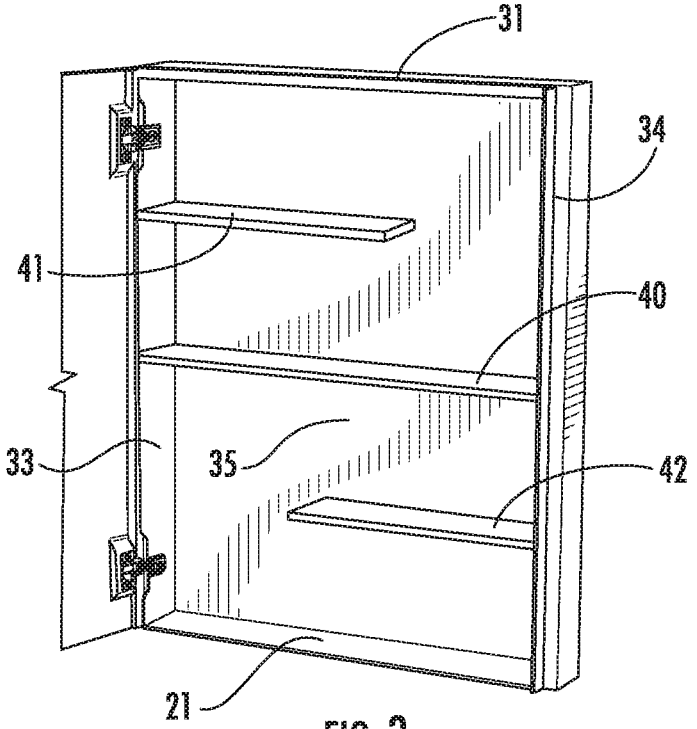
FIG. 3 is a partial perspective view of the medicine cabinet of FIG. 1, showing the shelves in greater detail.

FIGS. 1 and 2 illustrate an exemplary embodiment of a medicine cabinet 10 having a cabinet door 20 that is pivotally coupled to a cabinet box 30. A front surface 21 of the cabinet door includes a mirror surface, according to an exemplary embodiment. The cabinet box 30 includes a top panel 31, a bottom panel 32, two side panels 33, 34, and a rear panel 35. The rear panel 35 may be the mounting surface for the medicine cabinet 10 and may be configured to couple the cabinet box 40 to a structural wall or panel of a bathroom, according to an exemplary embodiment.

The cabinet box 30 includes a plurality of shelves 40, 41, 42. In particular, the cabinet box 30 includes a first shelf 40 extending an entire width of the cabinet box 30. The cabinet box 30 also includes a second shelf 41 and a third shelf 42 extending only a partial width of the cabinet box 30 (e.g., less than 75% of the total width of the cabinet, although the degree to which the shelf extends across the width of the cabinet may vary according to other exemplary embodiments). According to an exemplary embodiment, the first shelf 40 is disposed in the middle of the cabinet box, the second shelf 41 is disposed above the first shelf 40, and the third shelf 42 is disposed below the first shelf 40. Thus, because the second shelf 41 and the third shelf 42 only extend a partial width of the cabinet box, taller objects, such as an electric toothbrush 100 and a soap dispenser 200, may be placed in the spaces between the free ends of the second and third shelves 41,42 and the sides of the cabinet box. It should be noted that while one specific configuration of the medicine cabinet is shown in the accompanying figures, other configurations are possible (e.g., cabinets having all shelves that extend partially across the width of the cabinet, cabinets having a different number or arrangement of shelves, etc.).

According to the exemplary embodiment of FIGS. 1-2, the second shelf 41 and the third shelf 42 are each located equidistant from the first shelf 40. The second shelf 41 and the third shelf 42 are also disposed equidistant from a top panel 31 and from a bottom panel 32, respectively. According to other exemplary embodiments, the shelves are located at different distances relative to each other and to the panels of the cabinet box 30. In the embodiment of FIGS. 1-2, the second and third shelves 41, 42 extend from opposite sides of the cabinet box 30. For example, in the embodiment shown, the second shelf 41 extends from a left side panel 33 and the third shelf 42 extends from a right side panel 34. It is appreciated, however, that the shelves may extend from different panels of the cabinet box 30, according to other exemplary embodiments.

Figure 4:
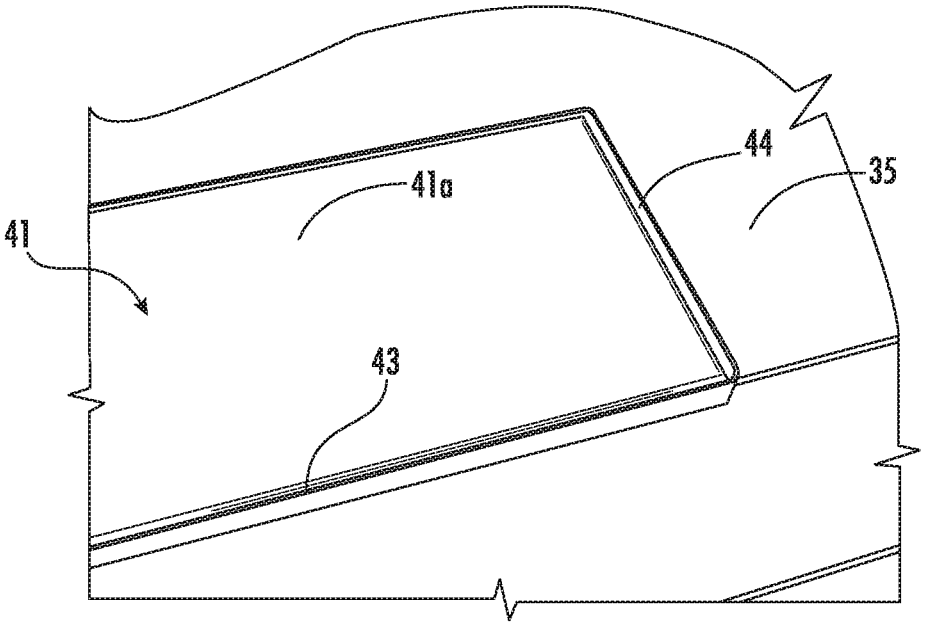
FIG. 4 is a partial perspective view of the shelves of the medicine cabinet of FIG. 1, showing the corner of the shelves and the retaining lips of the shelves in greater detail.

Referring now to FIG. 4, a portion of the second shelf 41 is shown. As shown in FIG. 4, the second shelf 41 includes a retaining lip 43 extending along a front peripheral edge of the shelf. The retaining lip 43 may extend above an upper surface 41*a* of the shelf, such that the retaining lip 43 may help to prevent objects from falling off of the front of the shelf. The retaining lip 43 may also extend below a bottom surface 41*b* of the second shelf, such that the second shelf 41 is reversible. The second shelf 41 also includes a retaining lip 44 extending along a side peripheral edge of the shelf. For example, the retaining lip 44 may be extend along the free end of the shelf 41 (i.e., the end that does not abut a side panel 33, 34). In this way, the retaining lip 44 on the end surface of the shelves may also prevent objects from rolling off an end of the shelf. Although the above description is directed to the second shelf 41, the retaining lips 43, 44 can be similarly applied to the third shelf 42.

Figure 5:
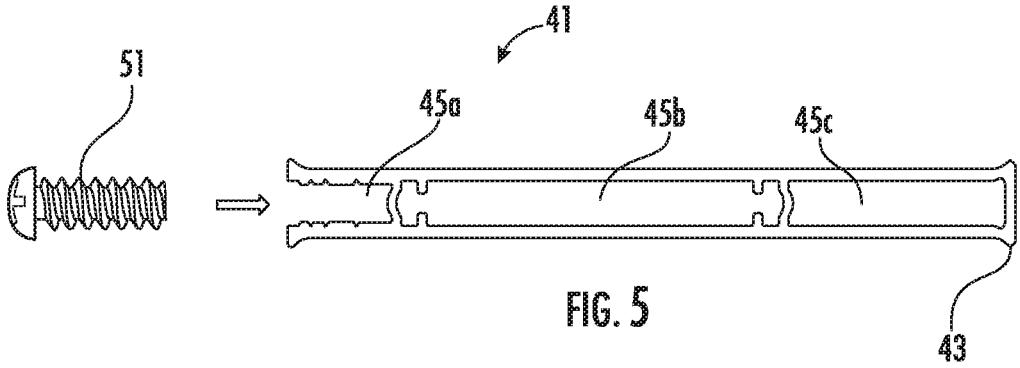
FIG. 5 is a cross-sectional view of a shelf of the medicine cabinet of FIG. 1.

Referring now to FIG. 5, the shelves 40, 41, 42 are each generally hollow, and include a plurality of fastener channels 45 disposed therein. According to an exemplary embodiment, each of the shelves 40, 41, 42 is an aluminum extrusion. As shown in FIG. 5, the second shelf 41 includes a rear fastener channel 45*a*, a first side fastener channel 45*b*, and a second side fastener channel 45*c*. According to an exemplary embodiment, the second shelf 41 is configured such that a fastener 51, shown as a screw, can pass through the rear panel 35 of the medicine cabinet 10, and be received within the rear fastener channel 45*a* (e.g., threadably received, press-fit, etc.). Similarly, the fastener 51 can pass through the side panel 33 and be received in at least one of the first side fastener channel 45*b* or the second side fastener channel 45*c*. In this way, the second shelf 41 can be removably coupled to the cabinet box 30 with the respective fasteners substantially concealed from view. In other words, the fastener channels 45*a*, 45*b*, 45*c* within the shelf facilitate concealment of the fasteners 51 from a user. Although the above discussion relates to the second shelf 41, the fastener channels 45*a*, 45*b*, 45*c* can be similarly applied to the first shelf 41 and the third shelf 42. According to other exemplary embodiments, the fastener 51 can be configured as another type of fastener suitable for coupling a shelf to the medicine cabinet 10.

Figure 6:
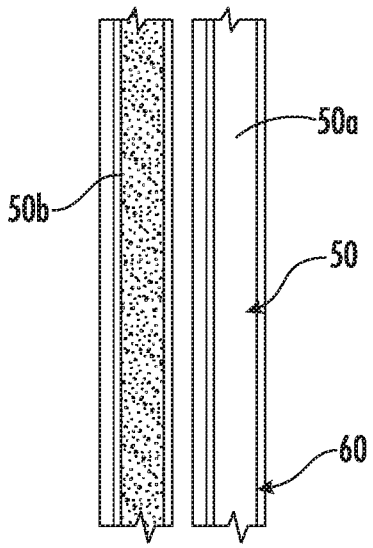
FIG. 6 is a partial side view of the aesthetic side panels of the medicine cabinet of FIG. 1.

Referring now to FIG. 6, the medicine cabinet 10 includes a plurality of aesthetic side panels 50 which are slidably coupled along an outer surface 33*a*, 34*a* of the side panels 33, 34 of the cabinet box 30. The aesthetic side panels 50 have a first color or pattern on a first side 50*a* and a second color or pattern on a second side 50*b*. For example, the first side 50*a* may have a white melamine coating to simulate white colored wood, and the second side 50*b* may have a brown melamine coating to simulate brown colored wood. One side of the aesthetic side panels may be facing the outer surface 33*a*, 34*a* of the side panel, while the other side of the aesthetic side panel may be visible to a user. In this way, the side panels may be reversible, and a user may choose which side they would like to be visible, depending on the particular application of the medicine cabinet. It should be noted that any of a wide variety of aesthetic possibilities may be employed for the side panels (e.g., different colors, textures, patterns, etc., and such panels may have the same aesthetic characteristics on both sides of the panels or may have differing aesthetic characteristics such as different colors, textures, patterns, etc.).

The cabinet box 30 further includes a plurality of vertical rails 60 extending along the side edges of the outer surface 33*a*, 34*a* of the side panels 33, 34. The cabinet box 30 also includes a plurality of generally L-shaped end caps 70, which are disposed on a bottom portion of the side panels 33, 34 and extend horizontally inward against a lower portion of the bottom panel 32. The rails 60 are configured to slidably receive the aesthetic side panels 50 from a bottom end of the cabinet box, such that the aesthetic side panels 50 can be slid in an upward direction within the rails 60 and held in place by the end caps 70. According to an exemplary embodiment, the end caps 70 are removable, and are configured to be press-fit into the bottom portion of the plurality of rails 60. The end caps 70 may be configured to prevent or impede sliding movement of the aesthetic side panels 50 relative to the side panels 33, 34. For example, a user may choose which side of the aesthetic side panel 50 they would like to be visible, slide the panel upward into the rails 60, and install the end cap 70 to hold the aesthetic side panels 50 in place.

Figure 7:
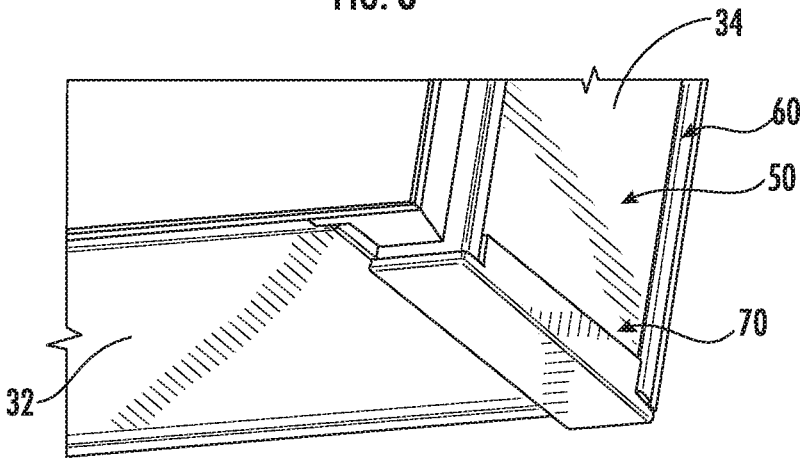
FIG. 7 is a partial perspective view illustrating the end caps of the medicine cabinet of FIG. 1.
Figure 8:
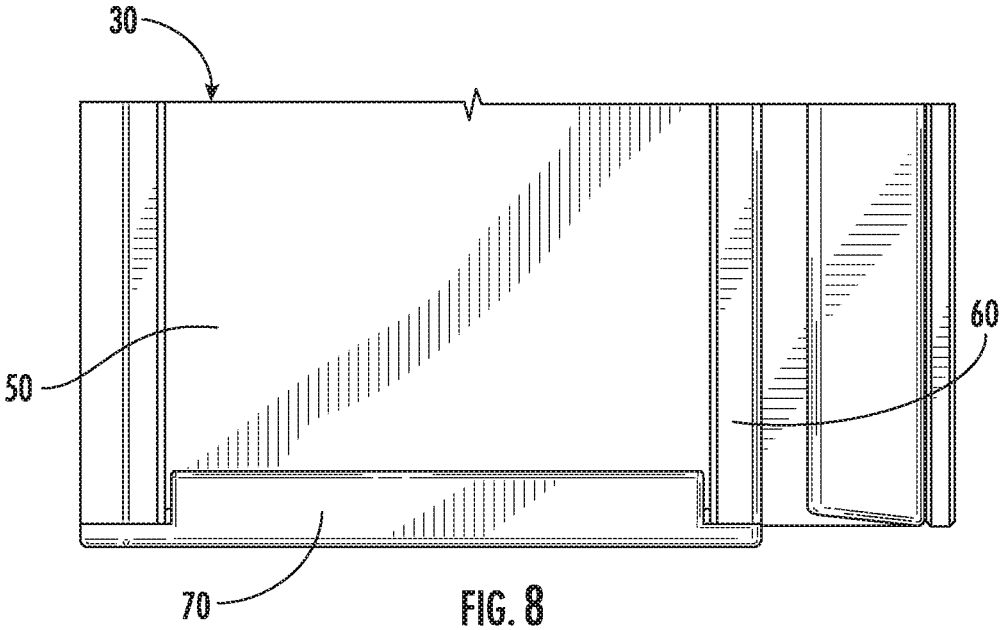
FIG. 8 is a detail view of the end caps of the medicine cabinet of FIG. 1.
Figure 9:
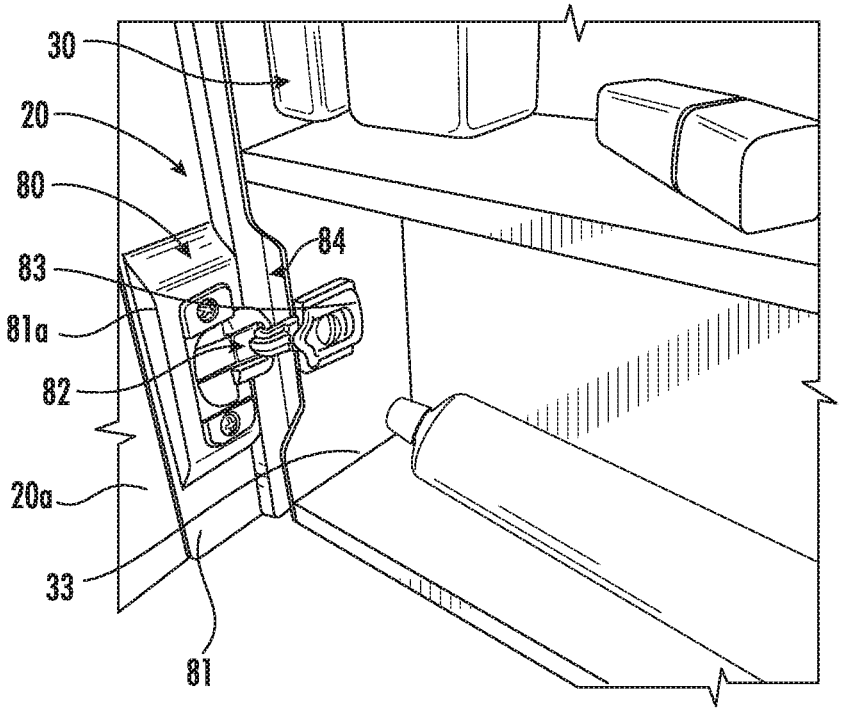
FIG. 9 is a perspective view of a hinge bar of the medicine cabinet of FIG. 1.
Figure 11:
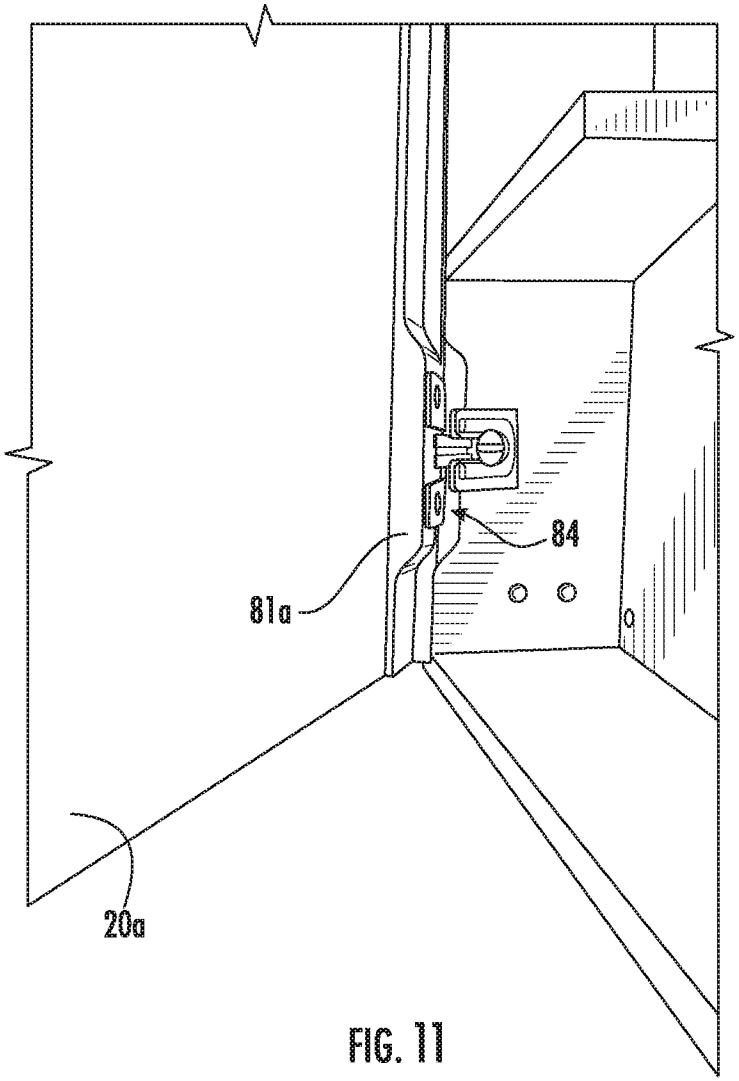
FIG. 11 another perspective view of the hinge bar of FIG. 9 being partially received in a notch of the medicine cabinet of FIG. 1 as the door is closed.
Figure 10:
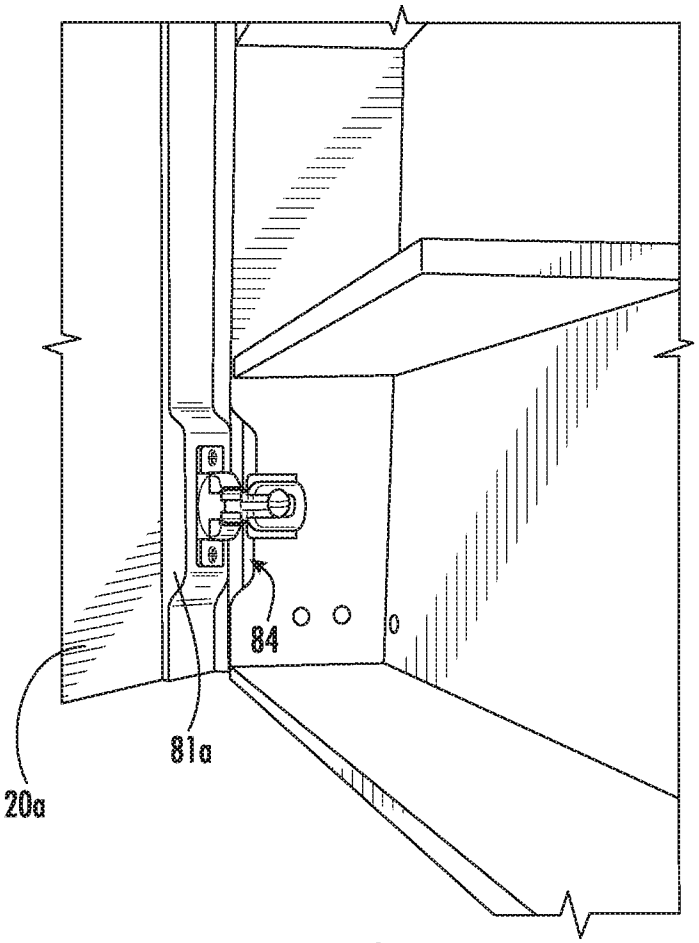
FIG. 10 is a perspective view of the hinge bar of FIG. 9 being partially received in a notch of the medicine cabinet of FIG. 1 as the door is closed.
Figure 12:
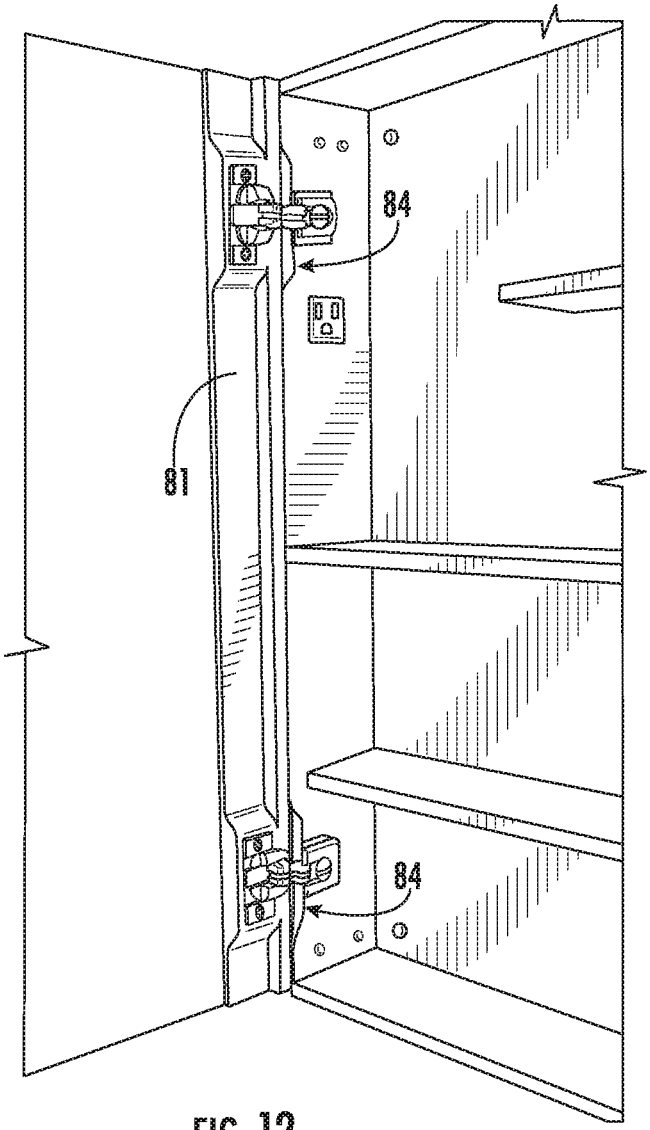
FIG. 12 is a perspective view of a pair hinge bars on the door of the medicine cabinet of FIG. 1.
Figure 13:
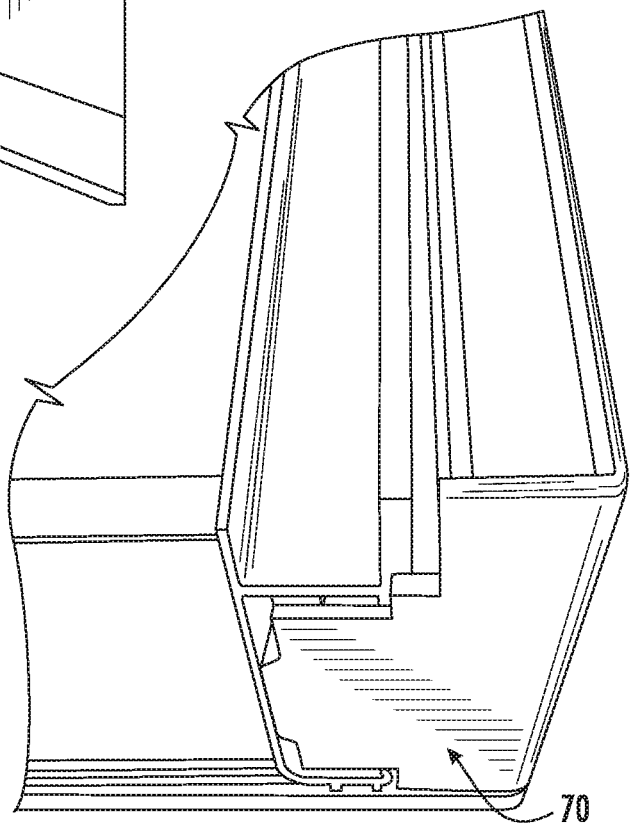
FIG. 13 is a perspective view of an end cap of the medicine cabinet of FIG. 1.

Additionally, as shown in FIGS. 7-8 and 13, the end caps 70 project downward away from the cabinet box 30, so as to function as a bumper or protector for the cabinet door 20. For example, as shown in the Figures, the bottom of the cabinet box 30 and the bottom of the cabinet door 20 (e.g., the mirror) are at generally the same level. However, when the end caps 70 are coupled to the cabinet box 30, the end caps 70 project vertically lower than the cabinet door 20. In this way, if, during shipping, installation, or use, the medicine cabinet 10 were to fall or be placed on a hard surface, the end caps 70 would contact the hard surface before the mirrored surface on the cabinet door 20, thereby helping to reduce the chance for damage to the mirrored surface.

Referring to FIGS. 9-12, the medicine cabinet 10 includes a hinge mechanism 80 which pivotally couples the cabinet door 20 to the cabinet box 30. The hinge mechanism 80 is disposed along a left side of the box 30. The hinge mechanism 80 is cooperatively defined by a hinge bar 81, a first hinge portion 82, and a second hinge portion 83. The hinge bar 81 extends along an inner surface 20*a* of the cabinet door 20. According to an exemplary embodiment, the first hinge portion 82 and the second hinge portion 83 collectively define a hinge that is a standard, off-the-shelf cabinet door hinge. The hinge bar 81 receives the first hinge portion 82 at a localized bulge or projection 81*a* extending outwardly from the inner surface 20*a* of the cabinet door 20. For example, the hinge bar 81 has a compact design, such that it has a minimal thickness along a substantial portion of the door and gradually transitions to a localized bulge or projection 81*a* where the first hinge portion 82 is coupled. According to an exemplary embodiment, the hinge bar 81 includes two projections 81*a* at each end of the door (see, for example, FIG. 12). A side edge of the side panel 33 of the cabinet box has a notch 84 (e.g., cutout, recessed portion, etc.) configured to receive the projection 81*a* and the first hinge portion 82 therein when the cabinet door 20 is in a closed position (see, for example, FIGS. 10-11). As shown in FIGS. 9-12, the notch 84 has an edge profile that is complementary to a surface profile of the projection 81*a*, such that the projection 81*a* is received in the notch 84 when the door 20 is in a closed position.

In other words, to provide for a more compact design, unlike many medicine cabinets where the hinge mechanism is typically disposed between the cabinet door and the cabinet box, which increases the overall thickness of the medicine cabinet, this embodiment advantageously enables a reduced overall thickness of the cabinet, because the first hinge portion 82 is generally recessed within the cabinet box 30 via the projection 81*a* and the notch 84. In addition, this configuration allows for the shelves to extend all the way toward an inner surface of the door 20, thereby maximizing the amount of storage space and reducing the likelihood that objects may fall from the front of the shelves within the cabinet when the door is closed. The second hinge portion 83 is coupled to the side panel 33 adjacent the notch 84 of the cabinet box 30, so as to pivotally couple the cabinet door 20 to the side panel. While this embodiment shows two hinge mechanisms 80, it should be appreciated that the medicine cabinet may include any number of hinge mechanisms 80.

In addition, the top panel 31 and bottom panel 32 of the medicine cabinet 10 are interchangeable, so the medicine cabinet 10 may be inverted for installation in an opposite hand configuration. That is to say, the medicine cabinet and the shelf locations have a symmetrical design to allow for the cabinet to be inverted for installation with hinges on the left side or right side of the cabinet.

The disclosed medicine cabinet overcomes the drawbacks of traditional medicine cabinets by providing a compact solution that allows for taller objects to be stored within the cabinet. The disclosed medicine cabinet also includes features that allow for customization of the medicine cabinet and can provide for improvements relating to shipping and installation of the cabinet. In addition, the disclosed medicine cabinet includes a compact hinge design that can reduce the overall size of the cabinet.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like, as used herein, mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the apparatus and control system as shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments.

Other substitutions, modifications, changes and omissions may also be made in the design, operating conditions and arrangement of the various exemplary embodiments without departing from the scope of the present invention. For example, any element disclosed in one embodiment may be incorporated or utilized with any other embodiment disclosed herein.

What is claimed is:

1. A medicine cabinet comprising:

a side panel including a notch on an edge of the side panel;

a door including a projection extending outwardly from an inner surface of the door; and a hinge pivotally coupling the door to the side panel, wherein the hinge includes a first portion coupled to the projection and a second portion coupled to an inner surface of the side panel; and wherein the projection and the first portion are received in the notch when the door is in a closed position.

2. The medicine cabinet of claim 1, wherein the hinge is a standard cabinet door hinge.

3. The medicine cabinet of claim 1, further comprising:

a rear panel coupled to the side panel opposite the edge; and a shelf extending from the rear panel, wherein the shelf extends to the inner surface of the door when the door is in a closed position.

4. The medicine cabinet of claim 3, wherein the shelf is cantilevered relative to at least one of the rear panel or the side panel, and wherein the shelf includes a retaining lip extending along a peripheral edge of the shelf above a top surface of the shelf.

5. The medicine cabinet of claim 3, wherein the shelf is a generally hollow extrusion, and wherein the shelf includes a fastener channel disposed therein for receiving a fastener to couple the shelf to at least one of the rear panel or the side panel.

6. The medicine cabinet of claim 1, wherein the notch is defined by an edge profile that is complementary to a surface profile of the projection.

7. The medicine cabinet of claim 1, wherein the door includes a mirrored front surface.

8. A medicine cabinet comprising:

a side panel including a cutout on a side edge of the side panel;

a door including a localized projection extending outwardly from an inner surface of the door; and a hinge pivotally coupling the door to the side panel, wherein the hinge includes a first portion coupled to the localized projection and a second portion coupled to the side panel; and wherein the localized projection and the first portion are received in the cutout only when the door is in a closed position.

9. The medicine cabinet of claim 8, wherein the hinge is a standard cabinet door hinge.

10. The medicine cabinet of claim 8, further comprising:

a rear panel coupled to the side panel opposite the edge; and a shelf extending from the rear panel, wherein the shelf extends to the inner surface of the door when the door is in a closed position.

11. The medicine cabinet of claim 10, wherein the shelf is cantilevered relative to at least one of the rear panel or the side panel, and wherein the shelf includes a retaining lip extending along a peripheral edge of the shelf above a top surface of the shelf.

12. The medicine cabinet of claim 10, wherein the shelf is a generally hollow extrusion, and wherein the shelf includes a fastener channel disposed therein for receiving a fastener to couple the shelf to at least one of the rear panel or the side panel.

13. The medicine cabinet of claim 8, wherein the cutout is defined by an edge profile that is complementary to a surface profile of the localized projection.

14. The medicine cabinet of claim 8, wherein the door includes a mirrored front surface.

15. A medicine cabinet comprising:

a side panel including a recessed portion along an edge of the side panel;

a door including a projection extending outwardly from an inner surface of the door; and a hinge pivotally coupling the door to the side panel, wherein the hinge includes a first portion coupled to the projection and a second portion coupled to the side panel at an interior of the medicine cabinet adjacent the recessed portion; and wherein the projection is received in the recessed portion only when the door is in a closed position.

16. The medicine cabinet of claim 15, wherein the hinge is a standard cabinet door hinge.

17. The medicine cabinet of claim 15, further comprising:

a rear panel coupled to the side panel opposite the edge; and a shelf extending from the rear panel, wherein the shelf extends to the inner surface of the door when the door is in a closed position.

18. The medicine cabinet of claim 17, wherein the shelf is cantilevered relative to at least one of the rear panel or the side panel, and wherein the shelf includes a retaining lip extending along a peripheral edge of the shelf above a top surface of the shelf.

19. The medicine cabinet of claim 17, wherein the shelf is a generally hollow extrusion, and wherein the shelf includes a fastener channel disposed therein for receiving a fastener to couple the shelf to at least one of the rear panel or the side panel.

20. The medicine cabinet of claim 15, wherein the recessed portion is defined by an edge profile that is complementary to a surface profile of the projection.

* * * * *